US009244403B2

(12) United States Patent
Hayashi et al.

(10) Patent No.: US 9,244,403 B2
(45) Date of Patent: Jan. 26, 2016

(54) FIXING DEVICE AND IMAGE FORMING APPARATUS

(71) Applicant: FUJI XEROX CO., LTD., Tokyo (JP)

(72) Inventors: Yoshihiro Hayashi, Kanagawa (JP); Yasuto Okabayashi, Kanagawa (JP); Toshiyuki Miyata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/689,115

(22) Filed: Nov. 29, 2012

(65) Prior Publication Data

US 2013/0272758 A1 Oct. 17, 2013

(30) Foreign Application Priority Data

Apr. 12, 2012 (JP) ..... 2012-090920

(51) Int. Cl.
*G03G 15/20* (2006.01)

(52) U.S. Cl.
CPC ..... *G03G 15/2053* (2013.01); *G03G 15/2017* (2013.01); *G03G 2215/00156* (2013.01); *G03G 2215/2032* (2013.01); *G03G 2215/2038* (2013.01)

(58) Field of Classification Search
None
See application file for complete search history.

(56) References Cited

U.S. PATENT DOCUMENTS

| | | | | |
|---|---|---|---|---|
| 6,088,558 | A * | 7/2000 | Yamada et al. | 399/165 |
| 6,246,858 | B1 * | 6/2001 | Condello et al. | 399/329 |
| 6,865,358 | B2 * | 3/2005 | Lee | 399/167 |
| 8,538,284 | B2 * | 9/2013 | Nakazato | 399/66 |
| 2006/0083562 | A1 | 4/2006 | Matsumoto et al. | |
| 2008/0317526 | A1 * | 12/2008 | Fujimori et al. | 399/329 |
| 2009/0180793 | A1 * | 7/2009 | Fujino | 399/68 |
| 2009/0317115 | A1 * | 12/2009 | Motoyama | 399/68 |
| 2010/0080598 | A1 * | 4/2010 | Nakazato | 399/66 |
| 2010/0278551 | A1 * | 11/2010 | Maruko et al. | 399/68 |
| 2011/0026989 | A1 * | 2/2011 | Chiba | 399/329 |
| 2011/0142480 | A1 * | 6/2011 | Miyata et al. | 399/92 |
| 2013/0148994 | A1 * | 6/2013 | Fukai | 399/67 |

FOREIGN PATENT DOCUMENTS

JP 2006-146154 A 6/2006

* cited by examiner

*Primary Examiner* — Clayton E Laballe
*Assistant Examiner* — Ruifeng Pu
(74) *Attorney, Agent, or Firm* — Sughrue Mion, PLLC

(57) ABSTRACT

A fixing device includes a heating member heating a recording medium to fix a developer image thereto; an endless heating belt rotatably wrapped around the heating member and heating the medium; a rotating member around which the belt is wrapped and having a fixed first axial end; a position detecting unit detecting a position of the belt when moved in first and second opposite directions parallel to an axial direction of the rotating member; and a controller controlling a rotational movement angle by which a second axial end of the rotating member is rotationally moved about the first end in an axis-intersecting direction based on information from the position detecting unit when the belt is moved in the first and second directions so that first and second speeds for respectively moving the belt in the first and second directions are made equal to or close to each other.

9 Claims, 6 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2012-090920 filed Apr. 12, 2012.

BACKGROUND

Technical Field

The present invention relates to fixing devices and image forming apparatuses.

SUMMARY

According to an aspect of the invention, there is provided a fixing device including a heating member, an endless heating belt, a rotating member around which the endless heating belt is wrapped, a position detecting unit, and a controller. The heating member heats a recording medium so as to fix an unfixed developer image transferred on the recording medium onto the recording medium. The endless heating belt is wrapped around the heating member in a rotatable manner in a circumferential direction of the endless heating belt and heats the recording medium. The rotating member is provided in a rotatable manner in a state where a first axial end thereof is fixed. The position detecting unit detects a position of the endless heating belt when the endless heating belt is moved in a first direction and a second direction, which are opposite to each other and extend parallel to an axial direction of the rotating member. The controller controls a rotational movement angle by which a second axial end of the rotating member is rotationally moved about the first axial end of the rotating member in a direction intersecting the axial direction on the basis of information from the position detecting unit when the endless heating belt is moved in the first direction and the second direction so that a first speed at which the endless heating belt is moved in the first direction is made equal to or close to a second speed at which the endless heating belt is moved in the second direction.

BRIEF DESCRIPTION OF THE DRAWINGS

Exemplary embodiments of the present invention will be described in detail based on the following figures, wherein.

DETAILED DESCRIPTION

Figure 1:
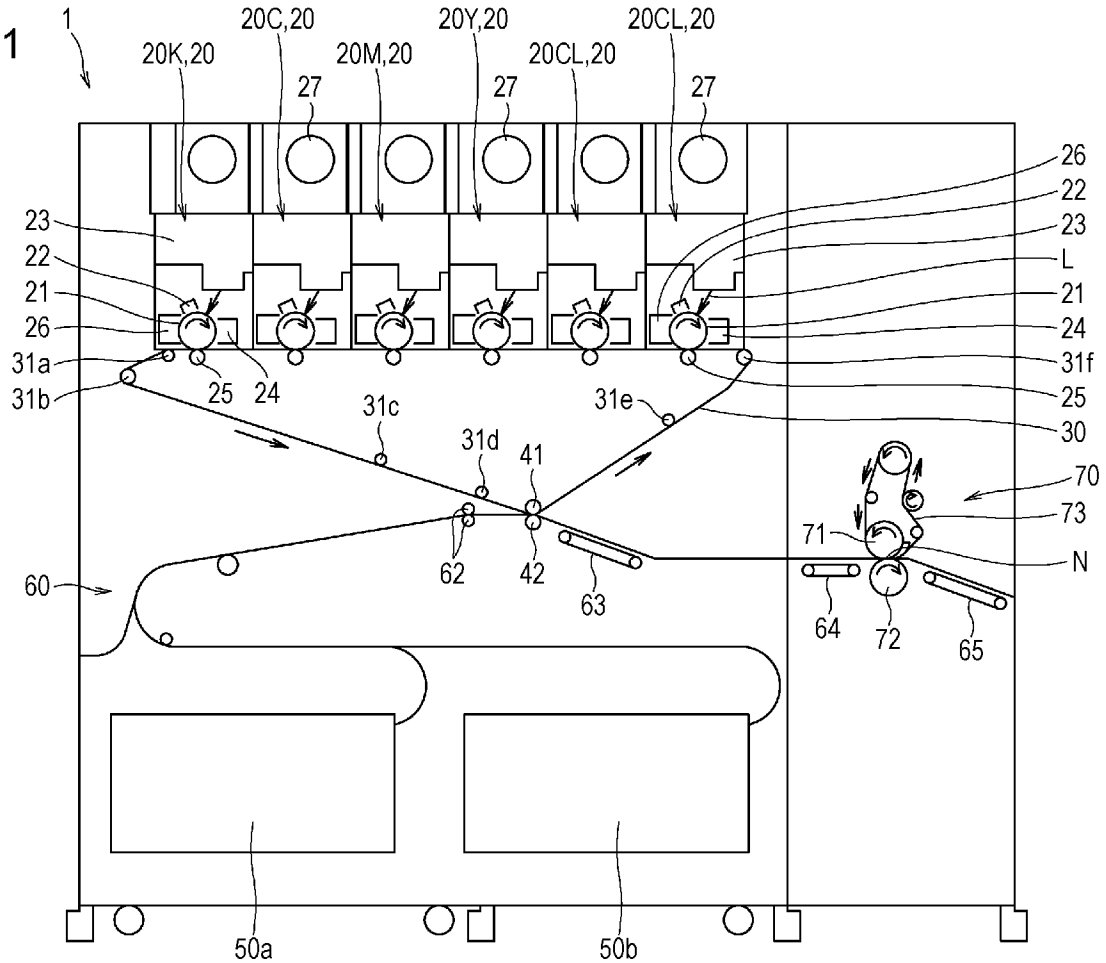
FIG. 1 schematically illustrates an image forming apparatus according to a first exemplary embodiment of the present invention.

Exemplary embodiments of the present invention will be described in detail below with reference to the drawings. In the drawings used for explaining the exemplary embodiments, the same components will basically be given the same reference numerals, and redundant descriptions thereof will be omitted.

First Exemplary Embodiment

FIG. 1 schematically illustrates an image forming apparatus 1 according to a first exemplary embodiment of the present invention.

The image forming apparatus 1 according to this exemplary embodiment is, for example, a tandem-type color printer and includes multiple image forming units 20, an intermediate transfer belt 30 as an example of an image bearing member, a backup roller 41 and a second-transfer roller 42 as an example of a transfer unit, sheet feed trays 50*a* and 50*b*, a sheet transport system 60, and a fixing device 70.

The image forming units 20 include four color image forming units 20Y, 20M, 20C, and 20K that respectively form, for example, yellow, magenta, cyan, and black toner images, and two transparent-color image forming units 20CL that transfer, for example, transparent-color toner images. The image forming units 20 first-transfer the toner images formed in accordance with image information for the respective colors onto the intermediate transfer belt 30.

In the rotational direction of the intermediate transfer belt 30, the six image forming units 20CL, 20Y, 20M, 20C, and 20K are arranged in the following order: transparent color, transparent color, yellow, magenta, cyan, and black. Alternatively, light-color image forming units that transfer light-color toner images, such as light yellow, light magenta, light cyan, or light black toner images, may be provided in place of the transparent-color image forming units 20CL. As another alternative, a transparent-color image forming unit 20CL and a light-color image forming unit may both be provided.

Each of the image forming units 20 includes a photoconductor drum 21, a charging device 22 that electrostatically charges the surface of the photoconductor drum 21 to a predetermined electric potential, an exposure device 23 that radiates laser light L onto the electrostatically-charged photoconductor drum 21 so as to form an electrostatic latent image thereon, a developing device 24 that forms a developer image by developing the electrostatic latent image formed on the photoconductor drum 21, a first-transfer roller 25 that transfers the developer image on the photoconductor drum 21 onto the intermediate transfer belt 30 at a first-transfer area, and a drum cleaner 26 that removes residual toner and paper particles from the surface of the photoconductor drum 21 after the developer image is transferred therefrom. A toner cartridge 27 that supplies a developer to the developing device 24 is disposed above the image forming unit 20.

In each image forming unit 20, the first-transfer roller 25 is disposed facing the photoconductor drum 21 with the intermediate transfer belt 30 interposed therebetween. When a transfer bias voltage with reversed polarity relative to the charge polarity of the toner is applied to the first-transfer roller 25, an electric field is generated between the photoconductor drum 21 and the first-transfer roller 25, so that the electrically-charged developer image on the photoconductor drum 21 is transferred onto the intermediate transfer belt 30 due to Coulomb force. The photoconductor drum 21 rotates clockwise for the first-transfer process.

The intermediate transfer belt 30 is a component to which the developer images of the respective color components formed by the image forming units 20 are sequentially transferred (first-transferred). The intermediate transfer belt 30 is an endless belt wrapped around multiple support rollers 31*a* to 31*f* and the backup roller 41. The intermediate transfer belt 30 rotates counterclockwise in the circumferential direction thereof while the developer images formed on the image forming units 20CL, 20Y, 20M, 20C, and 20K are first-transferred thereto.

The backup roller 41 and the second-transfer roller 42 forming a pair serve as a mechanism for forming a full-color image by collectively transferring the developer images superposed and transferred on the intermediate transfer belt 30 onto a sheet (as an example of a recording medium), and are disposed facing each other with the intermediate transfer belt 30 interposed therebetween. An area where the backup roller 41 and the second-transfer roller 42 face each other is a second-transfer area.

The backup roller 41 is rotatably disposed at the reverse side of the intermediate transfer belt 30, whereas the second-transfer roller 42 is rotatably disposed facing the developer-image transfer face of the intermediate transfer belt 30. The backup roller 41 and the second-transfer roller 42 are disposed such that the rotation axes thereof extending orthogonally to the plane of FIG. 1 are parallel to each other.

When transferring the developer images onto the intermediate transfer belt 30, a voltage with the same polarity as the charge polarity of the toners is applied to the backup roller 41, or a voltage with reversed polarity relative to the charge polarity of the toners is applied to the second-transfer roller 42. Thus, a transfer electric field is generated between the backup roller 41 and the second-transfer roller 42, whereby unfixed developer images on the intermediate transfer belt 30 are transferred onto the sheet.

The sheet feed trays 50*a* and 50*b* accommodate sheets of various sizes and thicknesses. A sheet in one of the sheet feed trays 50*a* and 50*b* is fetched by a pickup roller (not shown) of the sheet transport system 60 and is subsequently timing-controlled by a registration roller 62 of the sheet transport system 60 so as to be introduced to the second-transfer area, where the developer images are transferred onto the sheet. Then, the sheet is transported to the fixing device 70 via transport belts 63 and 64 of the sheet transport system 60.

The fixing device 70 fixes the unfixed developer images transferred on the sheet at the second-transfer area onto the sheet by thermo-compression, and includes a heating roller 71 as an example of a heating member, a pressing roller 72 disposed facing the heating roller 71, and a heating belt 73 moving through a fixation nip N formed between the heating roller 71 and the pressing roller 72.

After the second-transfer process, the sheet is transported to the fixation nip N and is output therefrom while being nipped between the heating belt 73 and the pressing roller 72. In this case, the sheet is heated by the heating roller 71 and the heating belt 73 and is pressed by the pressing roller 72, whereby the developer images are fixed onto the sheet. The sheet traveling through the fixing device 70 is transported to an output roller (not shown) via a transport belt 65 and is output outward from the image forming apparatus 1.

Figure 2:
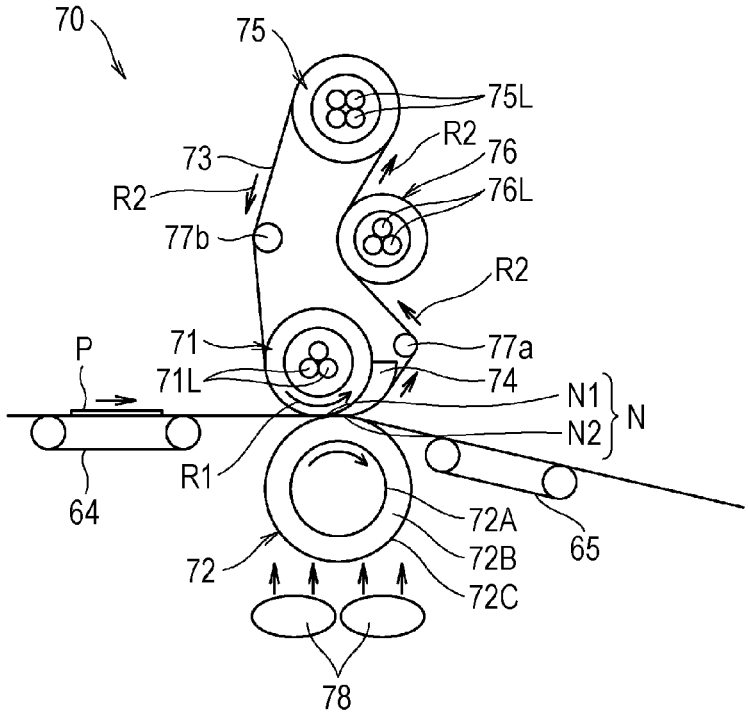
FIG. 2 schematically illustrates an example of a fixing device in the image forming apparatus in FIG. 1.

FIG. 2 schematically illustrates an example of the fixing device 70 shown in FIG. 1.

In addition to the heating roller 71, the pressing roller 72, and the heating belt 73 described above, the fixing device 70 includes a separating pad 74, an internal heating roller 75 as an example of a rotating member, an external heating roller 76, support rollers 77*a* and 77*b*, and a cooling fan 78.

The heating roller 71 heats a sheet P and the heating belt 73. The heating roller 71 is a cylindrical roller composed of a metallic material, such as aluminum, iron, or stainless steel, and has three heating sources 71L, such as halogen lamps, disposed therein.

Alternatively, the number of heating sources 71L may be two or smaller, or may be four or greater. Furthermore, multiple heating sources 71L with different calorific values may be disposed such that optimal temperature distribution is generated in accordance with the size of the sheet P, and these heating sources 71L may be selectively used in accordance with the size of the sheet P. Moreover, if the temperature differs between the center and the edges of the sheet P in the width direction (i.e., a direction orthogonal to the plane of FIG. 2) thereof, the heating sources 71L may be disposed in correspondence with the center and the edges of the sheet P in the width direction thereof so that the in-plane temperature of the sheet P is made uniform.

The heating roller 71 serves as a driving source for rotationally driving the pressing roller 72 and the heating belt 73, and is rotatable in a counterclockwise direction R1 by receiving a driving force from a rotational driving motor (not shown). When the heating roller 71 rotates, the sheet P is transported, and the pressing roller 72 and the heating belt 73 are rotated (slave-driven). A first fixation nip N1 is formed between the heating roller 71 and the pressing roller 72.

The separating pad 74 is disposed beside the heating roller 71 (i.e., at the downstream side thereof in the transport direction of the sheet P) such that the separating pad 74 is adjacent to the entire axial region of the heating roller 71. The separating pad 74 has a function of separating the sheet P from the heating belt 73 after the fixing process. A second fixation nip N2 is formed between the separating pad 74 and the pressing roller 72. Specifically, the fixation nip N in the fixing device 70 includes the first fixation nip N1 and the second fixation nip N2, and the fixation nip N is made longer as compared with a case where the separating pad 74 is not provided.

Oil is applied between the heating roller 71 and the heating belt 73, and also between the separating pad 74 and the heating belt 73. Thus, the contact resistance between the heating roller 71 and the heating belt 73 and the contact resistance between the separating pad 74 and the heating belt 73 are reduced, thereby allowing for smooth rotation of the heating belt 73. In addition, damage to the heating belt 73 caused by the heating roller 71 and the separating pad 74 coming into contact with each other and the separating pad 74 and the heating belt 73 coming into contact with each other may be suppressed or prevented.

The pressing roller 72 includes a hollow cylindrical cored bar 72A, an elastic layer 72B covering the outer periphery thereof, and a mold-release layer 72C covering the outer periphery of the elastic layer 72B. The cored bar 72A is composed of a metallic material, such as aluminum, iron, or stainless steel. The elastic layer 72B is composed of a heat-resistant insulating material, such as silicone rubber. The mold-release layer 72C is composed of, for example, a fluorine-based resin material.

The pressing roller 72 is disposed in a movable manner toward and away from the heating roller 71 and is pressed against the heating roller 71 by an elastic member (such as a spring) during the fixing process. Thus, the first and second fixation nips N1 and N2 described above are formed between the heating roller 71 and the pressing roller 72 and between the separating pad 74 and the pressing roller 72, respectively.

The heating belt 73 is an endless belt formed by laminating a mold-release layer composed of, for example, fluorine-based resin over a heat-resistant insulating material, such as polyimide resin. The heating belt 73 is wrapped around the heating roller 71, the internal heating roller 75, and the support rollers 77*a* and 77*b* and is rotatable in the circumferential direction (i.e., a counterclockwise direction R2).

The heating belt 73 is wrapped so as to travel through the first and second fixation nips N1 and N2. The sheet P transported to the first and second fixation nips N1 and N2 is heated by the heating roller 71 and the heating belt 73 while being nipped between the heating belt 73 and the pressing roller 72, and is also pressed by the pressing roller 72. Thus, the unfixed developer images on the sheet P become fixed onto the sheet P. The surface of the sheet P on which the developer images are formed is made to come into contact with the outer peripheral surface (i.e., the mold-release layer) of the heating belt 73.

If the sheet P is to be heated with the heating roller 71 alone without using the heating belt 73, the heat from the heating roller 71 would be absorbed by the sheet P during the fixing process, thus causing the heating temperature of the heating roller 71 to decrease. Since it takes time to increase the temperature to a sufficient value due to the heating roller 71 having a large heat capacity, the temperature for heating a subsequent sheet P during the fixing process therefor decreases.

In contrast, when the heating belt 73 is used, the temperature of the heating belt 73 is quickly increased to a sufficient value due to having a smaller heat capacity than the heating roller 71. Therefore, a decrease in the temperature for heating the subsequent sheet P during the fixing process therefor may be suppressed. Furthermore, when the heating belt 73 is used, the length thereof is made longer than the length of the sheet P in the transport direction thereof so that the temperature for heating the sheet P is made uniform over the entire area thereof in the transport direction, thereby suppressing or preventing uneven glossiness.

The internal heating roller 75 is disposed farther away from the pressing roller 72 than the heating roller 71 and the external heating roller 76 are from the pressing roller 72, and is rotatable by being slave-driven by the rotation of the heating belt 73.

The internal heating roller 75 is a cylindrical roller composed of a metallic material, such as aluminum, iron, or stainless steel, and has four heating sources 75L, such as halogen lamps, disposed therein for heating the heating belt 73 from the inner peripheral surface thereof.

Alternatively, the number of heating sources 75L may be three or smaller, or may be five or greater. Furthermore, multiple heating sources 75L with different calorific values may be disposed such that optimal temperature distribution is generated in accordance with the size of the sheet P, and these heating sources 75L may be selectively used in accordance with the size of the sheet P. Moreover, if the temperature differs between the center and the edges of the sheet P in the width direction (i.e., the direction orthogonal to the plane of FIG. 2) thereof, the heating sources 75L may be disposed in correspondence with the center and the edges of the sheet P in the width direction thereof so that the in-plane temperature of the sheet P is made uniform.

As another alternative, a rotating roller as an example of a rotating unit not provided with the heating sources 75L may be disposed at this position in place of the internal heating roller 75. This rotating roller only differs from the internal heating roller 75 in that the heating sources 75L are not provided, but is the same as the internal heating roller 75 with respect to the remaining configuration including a configuration to be described later.

The external heating roller 76 heats the heating belt 73 from the outer peripheral surface thereof and is disposed between the heating roller 71 and the internal heating roller 75. The external heating roller 76 is disposed in contact with the outside of the heating belt 73 so as to press the heating belt 73 toward the inside thereof, and is rotatable by being slave-driven by the rotation of the heating belt 73.

The external heating roller 76 is a cylindrical roller composed of a metallic material, such as aluminum, iron, or stainless steel, and has three heating sources 76L, such as halogen lamps, disposed therein.

Alternatively, the number of heating sources 76L may be two or smaller, or may be four or greater. Furthermore, multiple heating sources 76L with different calorific values may be disposed such that optimal temperature distribution is generated in accordance with the size of the sheet P, and these heating sources 76L may be selectively used in accordance with the size of the sheet P. Moreover, if the temperature differs between the center and the edges of the sheet P in the width direction (i.e., the direction orthogonal to the plane of FIG. 2) thereof, the heating sources 76L may be disposed in correspondence with the center and the edges of the sheet P in the width direction thereof so that the in-plane temperature of the sheet P is made uniform.

In the fixing device 70 described above, the unfixed developer images on the surface of the sheet P transported to the fixation nip N are fixed onto the sheet P by heat and pressure applied to the first fixation nip N1.

The heat applied to the first fixation nip N1 is supplied to the sheet P by the heating belt 73. Specifically, at the first fixation nip N1, heat energy is supplied to the sheet P from the heating belt 73 heated by the three heating rollers, i.e., the heating roller 71, the internal heating roller 75, and the external heating roller 76, whereby a sufficient amount of heat is ensured even in a high-speed process.

Furthermore, because the heating belt 73 has an extremely small heat capacity relative to the heating roller 71 and the like, and is in contact with the three heating rollers 71, 75, and 76 with wide wrap areas (i.e., large wrap angles), the heating belt 73 receives a sufficient amount of heat from the three heating rollers 71, 75, and 76 within a short period in which the heating belt 73 makes one rotation. Therefore, the temperature of the heating belt 73 returns to a sufficient fixation temperature within a short period of time, so that a predetermined fixation temperature is maintained at the first fixation nip N1.

Consequently, a sufficient fixation temperature is maintained in the fixing device 70 even when multiple sheets are successively fed at high speed. In addition, a so-called temperature droop phenomenon in which the fixation temperature drops when commencing a fixing process at high speed may be suppressed. In particular, the fixation temperature is maintained and the temperature droop phenomenon is suppressed even when a thick sheet of paper having a large heat capacity is used. In addition, even if the fixation temperature is to be increased or decreased in the middle of the process in accordance with the type of sheet used, because the heating belt 73 has a small heat capacity, the fixation temperature may be readily changed by adjusting the outputs from the heating sources 71L, 75L, and 76L.

Furthermore, because the heating roller 71 is composed of aluminum or the like, and the pressing roller 72 has the elastic layer, the surface of the pressing roller 72 bends at the first fixation nip N1 whereas the heating roller 71 hardly bends, whereby a fixation nip with a sufficient width in the moving direction of the heating belt 73 is formed. Therefore, at the first fixation nip N1, the side of the heating roller 71 around which the heating belt 73 is wrapped hardly deforms, so that the heating belt 73 passes through the first fixation nip N1 while the moving speed thereof is maintained at a preset speed. Consequently, the occurrence of wrinkling or distortion of the heating belt 73 at the first fixation nip N1 may be suppressed, whereby a high-quality, stable fixed image may be obtained.

The first fixation nip N1 has a shape of a downwardly-protruding curve due to the curvature of the heating roller 71, whereas the second fixation nip N2 has a shape of an upwardly-protruding curve due to the curvature of the pressing roller 72. Therefore, the traveling direction of the sheet P heated and pressed at the first fixation nip N1 under the curvature of the heating roller 71 is changed at the second fixation nip N2 due to the curvature of the pressing roller 72 oriented in the opposite direction. In this case, slight micro-slippage occurs between the developer images on the sheet P and the outer peripheral surface of the heating belt 73 so that the adhesive force between the developer images and the heating belt 73 is weakened, whereby the sheet P becomes readily separable from the heating belt 73. Accordingly, the second fixation nip N2 is an area corresponding to a preparation stage for reliably separating the sheet P in the final separating process.

At the exit of the second fixation nip N2, the heating belt 73 is transported in a wrapped state around the separating pad 74 so that the transport direction of the heating belt 73 suddenly changes at the exit. Therefore, the sheet P whose adhesive force against the heating belt 73 is weakened at the second fixation nip N2 becomes separated from the heating belt 73 due to the resilience of the sheet P. The separated sheet P is transported toward a cooling unit (not shown) via the transport belt 65 and the like.

In the belt-type fixing device 70 described above, when multiple sheets of thick paper or the like are processed, the heating belt 73 may possibly become damaged when extremely large pressure is applied to an area thereof that comes into contact with an edge of thick paper. When such thick paper is replaced with a large-size sheet of paper, the damaged area may possibly be reflected on an image on the sheet.

Hence, the heating belt 73 is reciprocated equally in the order of millimeters in the axial direction (i.e., longitudinal direction) of the internal heating roller 75, so that the damage occurring in the heating belt 73 is distributed. Specifically, when the same area of the heating belt 73 is repeatedly damaged, the damaged area becomes larger, leading to greater deterioration in image quality. In contrast, by reciprocating the heating belt 73 in the left-right direction, the damaged area is shifted so that the same area is prevented from being repeatedly damaged, thereby suppressing or preventing image-quality deterioration caused by a damaged area in the heating belt 73. In this case, although the glossiness of the image may be reduced, the lifespan of the fixing device 70 is extended since image-quality deterioration caused by a damaged area in the heating belt 73 is suppressed or prevented.

Figure 3:
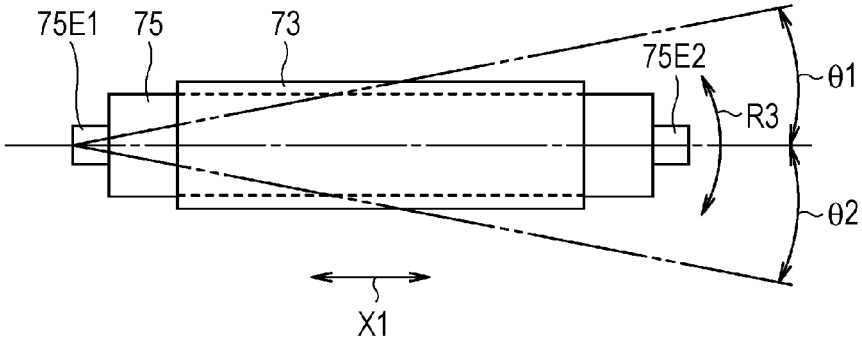
FIG. 3 is a plan view of a heating belt and an internal heating roller when the fixing device in FIG. 2 is viewed from above.

FIG. 3 is a plan view of the heating belt 73 and the internal heating roller 75 when the fixing device 70 in FIG. 2 is viewed from above.

In this exemplary embodiment, a first axial end 75E1 of the internal heating roller 75 is fixed to the front surface or the rear surface of the image forming apparatus 1, whereas a second axial end 75E2 of the internal heating roller 75 is rotationally movable by a driver (not shown in FIG. 3), such as a motor, in a direction R3 (simply referred to as "axis-intersecting direction" hereinafter) intersecting the axial direction of the internal heating roller 75.

By rotationally moving the second end 75E2 of the internal heating roller 75 in the axis-intersecting direction R3 about the fixed first end 75E1, the heating belt 73 is reciprocated in the axial direction, indicated by an arrow X1, of the internal heating roller 75. The reciprocation of the heating belt 73 is controlled on the basis of steering angles θ1 and θ2 (as an example of rotational movement angles) used when moving the second end 75E2 of the internal heating roller 75 in the axis-intersecting direction R3.

Alternatively, when reciprocating the heating belt 73, both axial ends of the internal heating roller 75 may be moved in the direction intersecting the axial direction thereof. In this case, the two axial ends of the internal heating roller 75 may be moved symmetrically for reciprocating the heating belt 73. However, in actuality, it is difficult to control the movement of both axial ends of the internal heating roller 75, and moreover, drivers, such as motors, are provided for both axial ends of the internal heating roller 75, leading to an increase in size and cost of the device.

Unlike the above case where both axial ends of the internal heating roller 75 are operated, this exemplary embodiment achieves facilitated control by simply operating the second axial end 75E2 and only uses a single driver, such as a motor, thereby achieving size reduction and cost reduction. However, when one end of the internal heating roller 75 is fixed, the internal heating roller 75 becomes unsymmetrical for the reciprocation of the heating belt 73, causing the heating belt 73 to become readily unbalanced toward one of the axial ends of the internal heating roller 75. In addition, due to individual differences between fixing devices 70 and changes occurring in components and materials over time, the controllability of the aforementioned steering angles θ1 and θ2 may deteriorate. Since this may cause variations in the reciprocation of the heating belt 73, damaged positions along the widthwise edges of the heating belt 73 may vary, possibly resulting in uneven glossiness in an image. If the heating belt 73 moves excessively toward one of the axial ends of the internal heating roller 75 and abuts on a housing of the image forming apparatus 1, the heating belt 73 may possibly become abraded or break.

In light of this, a position detector (not shown in FIG. 3) that detects the position of the heating belt 73 is provided at each of or one of the axial ends of the internal heating roller 75 in this exemplary embodiment. Based on information from the position detector or detectors, the steering angles θ1 and θ2 for the internal heating roller 75 are controlled so that the moving period (speed) in which the reciprocating heating belt 73 moves in a first direction is made equal to or close to the moving period (speed) in which the reciprocating heating belt 73 moves in a second direction. Thus, damaged positions along the widthwise edges of the heating belt 73 may be evenly distributed, and differences in the damaged positions between the widthwise edges of the heating belt 73 may be eliminated, thereby reducing uneven glossiness in an image fixed by the fixing device 70.

In addition, the steering angles θ1 and θ2 for the internal heating roller 75 are controlled such that an optimal time period (speed) in which the moving period (speed) of the reciprocating heating belt 73 moving in the first direction and the moving period (speed) of the reciprocating heating belt 73 moving in the second direction are balanced is achieved. Accordingly, the heating belt 73 may be prevented from moving excessively, whereby the heating belt 73 may be prevented from becoming abraded or breaking by abutting on the housing of the image forming apparatus 1.

Figure 4A:
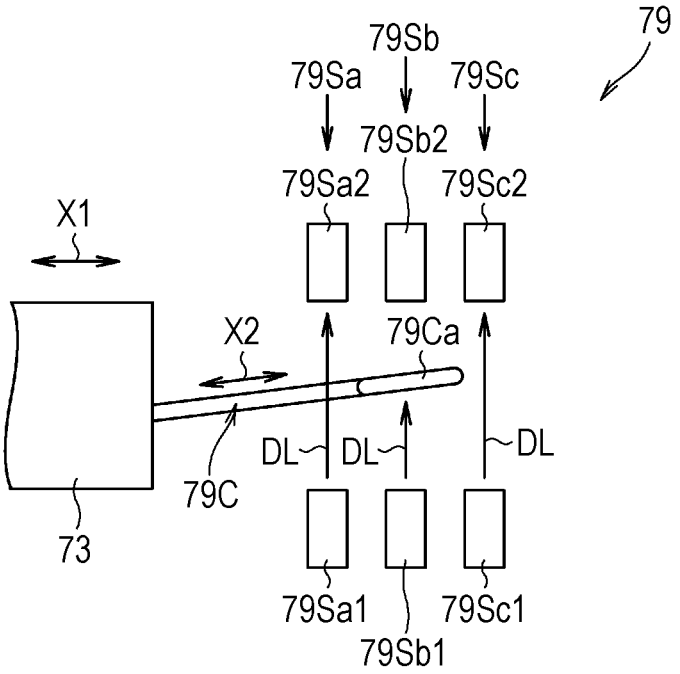
FIGS. 4A and 4B schematically illustrate an example of a position detector that detects the position of the heating belt of the fixing device in FIG. 2.
Figure 4B:
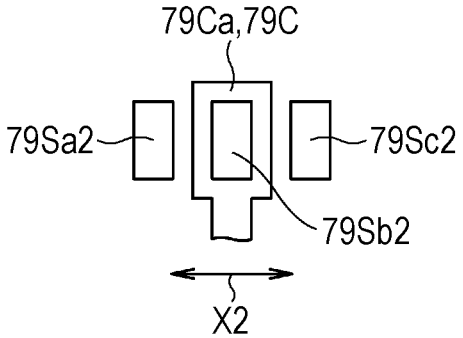

FIGS. 4A and 4B schematically illustrate an example of a position detector 79 described above as an example of a position detecting unit that detects the position of the heating belt 73.

The position detector 79 is disposed at, for example, one axial end of the internal heating roller 75. Alternatively, the position detector 79 may be disposed at each of the two axial ends of the internal heating roller 75. If the position detector 79 is provided at one end of the internal heating roller 75, size reduction and cost reduction are achieved, as compared with the case where the position detectors 79 are provided at both ends. If the position detectors 79 are provided at both ends, the position detection accuracy is improved, as compared with the case where the position detector 79 is provided at one end.

The position detector 79 includes, for example, three sensors 79Sa to 79Sc and a single control shaft 79C. The sensors 79Sa to 79Sc are, for example, photo-sensors and respectively include light emitters 79Sa1 to 79Sc1 that emit detection light DL and light receivers 79Sa2 to 79Sc2 that receive the detection light DL.

The light emitters 79Sa1 to 79Sc1 and the light receivers 79Sa2 to 79Sc2 forming pairs are arranged in the axial direction of the internal heating roller 75 and respectively face each other so as to emit and receive the detection light DL.

The light receivers 79Sa2 to 79Sc2 are electrically connected to a central processing unit (CPU), to be described later, and each convert the detection light DL into an electric signal and transmit the electric signal to the CPU.

A first axial end of the control shaft 79C is pressed against the corresponding widthwise edge of the heating belt 73 by an elastic member, such as a spring, whereas a second axial end of the control shaft 79C is disposed in a movable manner in the axial direction thereof indicated by an arrow X2 between the light emitters 79Sa1 to 79Sc1 and the light receivers 79Sa2 to 79Sc2.

The second end of the control shaft 79C is integrally provided with a light blocking portion 79Ca that blocks the detection light DL. When the heating belt 73 reciprocates, the control shaft 79C moves correspondingly in the direction of the arrow X2 so that the position of the light blocking portion 79Ca changes, whereby the position of the heating belt 73 is detected. For example, the aforementioned CPU is defined such that, when the detection light DL is blocked by the light blocking portion 79Ca, the CPU detects an "ON" state. For illustrative purposes, FIG. 4B shows the light receiver 79Sb2 in the middle as viewed through the light blocking portion 79Ca.

Figure 5:
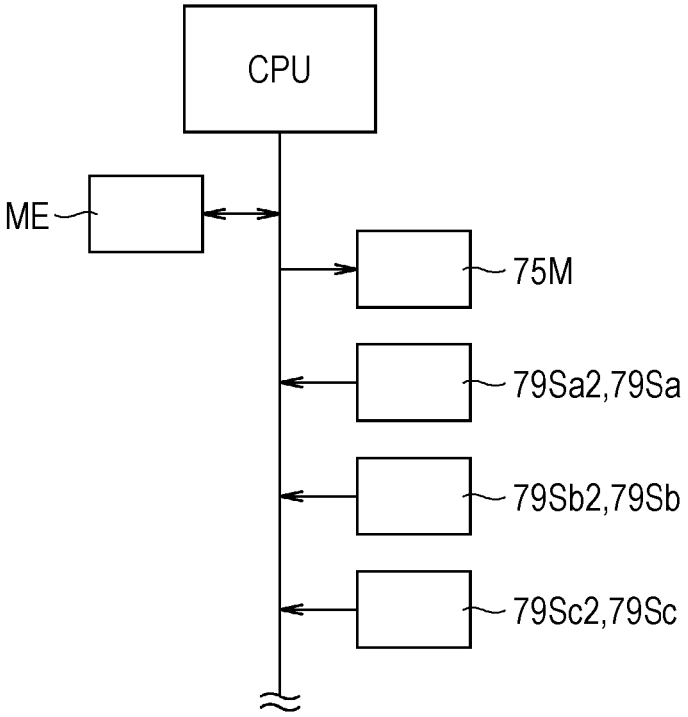
FIG. 5 is a circuit block diagram illustrating an example related to control of reciprocation of the heating belt in the fixing device shown in FIG. 2.

FIG. 5 is a circuit block diagram illustrating an example related to control of the reciprocation of the heating belt 73 in the fixing device 70 shown in FIG. 2.

The CPU as an example of a controller controls image processing in the image forming apparatus 1. The CPU is electrically connected to a memory ME, and is also electrically connected to the light receivers 79Sa2 to 79Sc2 of the aforementioned sensors 79Sa to 79Sc and to a driver 75M that rotationally moves the second end 75E2 of the internal heating roller 75 in the axis-intersecting direction R3.

In the operation of the fixing device 70, detection signals obtained by the light receivers 79Sa2 to 79Sc2 of the sensors 79Sa to 79Sc are transmitted to the CPU. The CPU ascertains the position of the heating belt 73 on the basis of the detection signals and controls the operation of the driver 75M (i.e., the steering angles θ1 and θ2) so that the moving period (speed) in which the reciprocating heating belt 73 moves in the first direction is made equal to or close to the moving period (speed) in which the reciprocating heating belt 73 moves in the second direction. Accordingly, uneven glossiness in an image fixed by the fixing device 70 may be reduced.

In addition, the operation of the driver 75M (i.e., the steering angles θ1 and θ2) is controlled such that an optimal time period (speed) in which the moving period (speed) of the reciprocating heating belt 73 moving in the first direction and the moving period (speed) of the reciprocating heating belt 73 moving in the second direction are balanced is achieved. Accordingly, the heating belt 73 may be prevented from becoming abraded or breaking.

Furthermore, the steering angles θ1 and θ2 for the internal heating roller 75 are preliminarily stored in the memory ME in accordance with the state of the fixing process, such as the state of the fixing device 70 (e.g., the latched state between the heating roller 71 and the pressing roller 72) or the traveling state (e.g., the quality or the basis weight of the sheet P), and are used as initial preset values for the steering angles θ1 and θ2 when switching the state. Accordingly, the time period for performing initial setting related to the reciprocation of the endless heating belt 73 when switching the state of the fixing process may be shortened.

Furthermore, a maximum moving distance for the reciprocation of the heating belt 73 may be changed in the fixing device 70 in accordance with the type of sheet P used (such as the thickness or the material thereof). For example, if a thin sheet of paper is used, since the sheet has a small heat capacity and the rotation speed of the heating belt 73 is high from a standpoint of a high-speed process, the turn-around points of the reciprocating heating belt 73 are detected early so as to prevent the edges of the heating belt 73 from moving excessively. When a thick sheet of paper is used, since the sheet has a large heat capacity, the rotation speed of the heating belt 73 is reduced relative to that for a thin sheet of paper so as to sufficiently heat the thick sheet. In addition, the thick sheet may cause greater damage to the heating belt 73. In view of these factors, it is better to increase the distance for the reciprocation of the heating belt 73 so that the damaged positions can be distributed, thus reducing deterioration in image quality caused by the damaged positions. Therefore, for example, when performing a fixing process on a thick sheet of paper, the distance for the reciprocation of the heating belt 73 is increased relative to that for a thin sheet of paper. Accordingly, even when a thick sheet of paper that tends to form scratches on the heating belt 73 is used, the heating belt 73 reciprocates by an increased distance so that the damaged positions may be further distributed, thereby suppressing image-quality deterioration and reducing uneven glossiness in an image.

However, even in the same sheet P, the sheet P is sometimes made to travel at different traveling speeds. Therefore, the maximum moving distance for the reciprocation of the heating belt 73 may be changed in the fixing device 70 in accordance with the traveling speed of the sheet P. For example, when the sheet P travels at low speed, the moving distance for the reciprocation of the heating belt 73 is increased. Accordingly, the heating belt 73 reciprocates by a larger distance so that the damaged positions may be further distributed, thereby suppressing image-quality deterioration and reducing uneven glossiness in an image.

Next, an example of control of the reciprocation of the heating belt 73 during the fixing process will be described below with reference to FIGS. 3 to 6. For illustrative purposes, FIG. 6 shows the light receivers 79Sa2 to 79Sc2 as viewed through the light blocking portion 79Ca.

Figure 6:
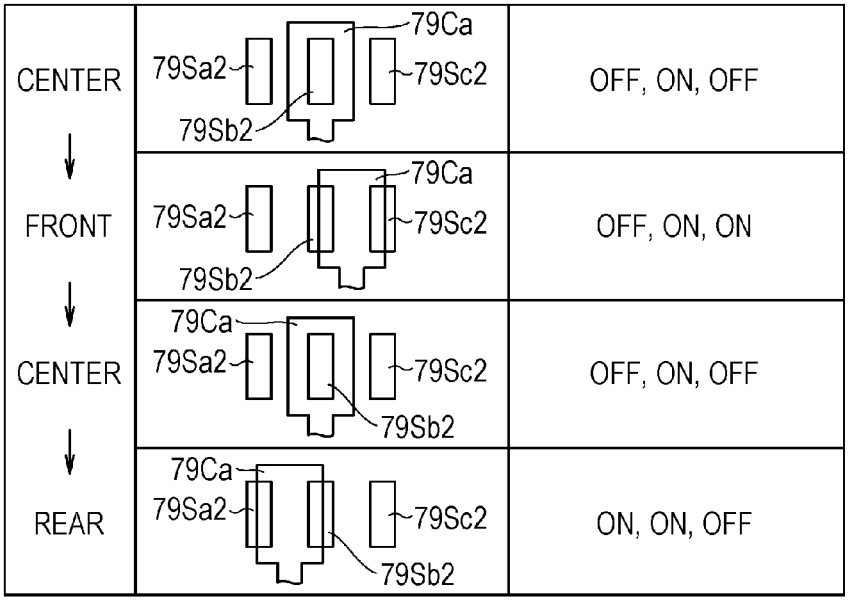
FIG. 6 illustrates an example of control of the reciprocation of the heating belt during operation of the fixing device in FIG. 2.

The first row in FIG. 6 shows relevant detection components of the position detector 79 when the heating belt 73 is positioned at the center of the internal heating roller 75 in the axial direction thereof. At this stage, the light blocking portion 79Ca of the control shaft 79C only blocks the detection light DL entering the light receiver 79Sb2 of the middle sensor 79Sb. In this case, the detection states of the sensors 79Sa to 79Sc are "off", "on", and "off" in that order from the left.

Subsequently, when the heating belt 73 is moved in the axial direction of the internal heating roller 75 toward the front surface of the image forming apparatus 1 from the state shown in the first row, the light blocking portion 79Ca of the control shaft 79C pressed by the corresponding edge of the heating belt 73 is positioned to block the detection light DL entering the light receivers 79Sb2 and 79Sc2 of the two sensors 79Sb and 79Sc at the right side, as shown in the second row in FIG. 6. In this case, the detection states of the sensors 79Sa to 79Sc are "off", "on", and "on" in that order from the left. Then, the CPU determines that the heating belt 73 has reached the turn-around point near the second axial end 75E2 of the internal heating roller 75 and causes the driver 75M to move the second axial end 75E2 of the internal heating roller 75 by predetermined steering angles θ1 and θ2 in the axis-intersecting direction R3 so that the heating belt 73 is moved in the opposite direction toward the rear surface of the image forming apparatus 1.

Subsequently, when the heating belt 73 is moved toward the center from the second axial end 75E2 of the internal heating roller 75, the control shaft 79C also moves so that the light blocking portion 79Ca of the control shaft 79C is positioned to block the detection light DL entering the light receiver 79Sb2 of the middle sensor 79Sb, as shown in the third row in FIG. 6. In this case, the detection states of the sensors 79Sa to 79Sc are "off", "on", and "off" in that order from the left.

Subsequently, when the heating belt 73 is moved toward the first axial end 75E1 of the internal heating roller 75 from the center thereof, the control shaft 79C also moves so that the light blocking portion 79Ca is positioned to block the detection light DL entering the light receivers 79Sa2 and 79Sb2 of the sensors 79Sa and 79Sb, as shown in the fourth row in FIG. 6. In this case, the detection states of the sensors 79Sa to 79Sc are "on", "on", and "off" in that order from the left. Then, the CPU determines that the heating belt 73 has reached the turn-around point near the first axial end 75E1 of the internal heating roller 75 and causes the driver 75M to move the second axial end 75E2 of the internal heating roller 75 by predetermined steering angles θ1 and θ2 in the axis-intersecting direction R3 so that the heating belt 73 is moved in the opposite direction toward the front surface of the image forming apparatus 1.

When reciprocating the heating belt 73 in this manner in this exemplary embodiment, the steering angles θ1 and θ2 for the internal heating roller 75 are controlled so that the time period (speed) in which the heating belt 73 moves from the front surface toward the rear surface of the image forming apparatus 1 and the time period (speed) in which the heating belt 73 moves from the rear surface toward the front surface are made equal to or close to each other. Accordingly, damaged positions along the widthwise edges of the heating belt 73 may be evenly distributed, and differences in the damaged positions between the widthwise edges of the heating belt 73 may be eliminated, thereby reducing uneven glossiness in an image fixed by the fixing device 70.

Furthermore, the steering angles θ1 and θ2 for the internal heating roller 75 are controlled such that an optimal period (speed) in which the moving period (speed) of the heating belt 73 moving from the front surface toward the rear surface of the image forming apparatus 1 and the moving period (speed) of the heating belt 73 moving from the rear surface toward the front surface are balanced is achieved. Accordingly, the heating belt 73 may be prevented from moving excessively, whereby the heating belt 73 may be prevented from becoming abraded or breaking.

Furthermore, the steering angles θ1 and θ2 for the internal heating roller 75 are preliminarily stored in the memory ME in accordance with the state of the fixing process, such as the state of the fixing device 70 (e.g., the latched state between the heating roller 71 and the pressing roller 72) or the traveling state (e.g., the quality or the basis weight of the sheet P), and are used as initial preset values for the steering angles θ1 and θ2 when switching the state. Accordingly, the time period for performing initial setting related to the reciprocation of the endless heating belt 73 when switching the state of the fixing process may be shortened.

Furthermore, the maximum moving distance for the reciprocation of the heating belt 73 may be changed in accordance with the type of sheet P used (such as the thickness or the material thereof) or the traveling speed of the sheet P. For example, when performing a fixing process on a thick sheet of paper, the distance for the reciprocation of the heating belt 73 is increased relative to that for a thin sheet of paper. Accordingly, even when a thick sheet of paper that tends to form scratches on the heating belt 73 is used, the heating belt 73 reciprocates by an increased distance so that the damaged positions may be further distributed, thereby suppressing image-quality deterioration and reducing uneven glossiness in an image.

In order to increase the distance for the reciprocation of the heating belt 73 when performing a fixing process on a thick sheet of paper, the turn-around points of the heating belt 73 may be changed. For example, in the above example, it is determined that the heating belt 73 has reached one of the turn-around points of the reciprocation when the detection states of the sensors 79Sa to 79Sc are "off", "on", and "on", or "on", "on", and "off", as shown in the second row or the fourth row in FIG. 6. Alternatively, it may be determined that the heating belt 73 has reached one of the turn-around points of the reciprocation when the outermost sensor 79Sa or 79Sc is in the "on" state, such as when the detection states of the sensors 79Sa to 79Sc are "off", "off", and "on", or "on", "off", and "off".

As another example, the position detector 79 may include, for example, four sensors. In this case, when the sheet P is a thin sheet of paper, one of the outermost sensors may be disabled by being turned off. When the sheet P is changed to a thick sheet of paper, the outermost sensor may be enabled so that when the outermost sensor is detected as being in the "on" state, the reciprocating heating belt 73 may be determined that it has reached the corresponding turn-around point. Alternatively, the number of sensors in the position detector 79 may be four or more.

Second Exemplary Embodiment

Figure 7:
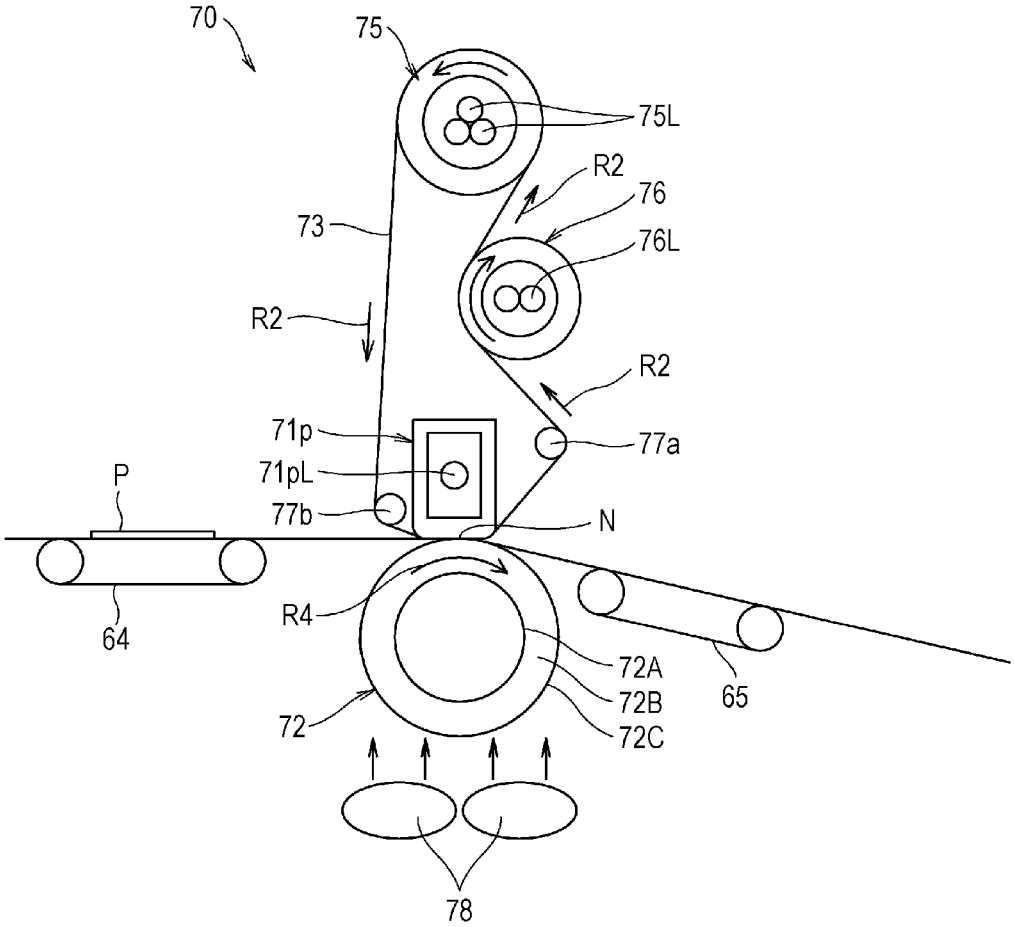
FIG. 7 schematically illustrates an example of a fixing device in an image forming apparatus according to a second exemplary embodiment of the present invention.

FIG. 7 schematically illustrates a fixing device 70 in an image forming apparatus 1 according to a second exemplary embodiment of the present invention.

In the fixing device 70 according to this exemplary embodiment, a heating pad 71*p* is provided in place of the heating roller 71 and the separating pad 74 described above. The fixation nip N is formed between the heating pad 71*p* and the pressing roller 72. In this case, image misalignment may be suppressed or prevented since the fixation nip N has no inflection points. Therefore, image defects may be suppressed or prevented.

The heating pad 71*p* heats the sheet P and the heating belt 73. The heating pad 71*p* is formed of a tubular member composed of, for example, aluminum, iron, or stainless steel. A surface of the heating pad 71*p* that is in contact with the heating belt 73 may be provided with a sliding sheet for reducing the sliding load. In that case, a small amount of oil is supplied between the inner surface of the heating belt 73 and the surface of the sliding sheet via an oil supply member within the heating belt 73.

A single heating source 71*p*L, such as a halogen lamp, is disposed within the tubular heating pad 71*p*. Alternatively, the number of heating sources 71*p*L may be two or more. Furthermore, multiple heating sources 71*p*L with different calorific values may be disposed such that optimal temperature distribution is generated in accordance with the size of the sheet P, and these heating sources 71*p*L may be selectively used in accordance with the size of the sheet P. Moreover, if the temperature differs between the center and the edges of the sheet P in the width direction (i.e., a direction orthogonal to the plane of FIG. 7) thereof, the heating sources 71*p*L may be disposed in correspondence with the center and the edges of the sheet P in the width direction thereof so that the in-plane temperature of the sheet P is made uniform.

In this case, the pressing roller 72 serves as a rotational driving source for the heating belt 73 and is disposed in a rotatable manner in a clockwise direction R4 by a rotation driver, such as a rotational driving motor.

Specifically, when the pressing roller 72 rotates, the sheet P is transported downstream, and the heating belt 73 is rotated (slave-driven) in the circumferential direction thereof (i.e., the counterclockwise direction R2). Then, due to the rotation of the heating belt 73, the internal heating roller 75 and the external heating roller 76 are rotated (slave-driven).

In such a fixing device 70, the configuration related to the control for reciprocating the heating belt 73 in the axial direction of the internal heating roller 75 is the same as that in the first exemplary embodiment. Therefore, the description of the configuration will be omitted.

Although the exemplary embodiments of the present invention have been described in detail above, the foregoing description of the exemplary embodiments disclosed in this specification has been provided for the purposes of illustration and description in all aspects and is not intended to limit the exemplary embodiments of the invention to the technologies disclosed. Specifically, the technical scope of the exemplary embodiments of the invention should not be interpreted limitedly based on the description of the above exemplary embodiments but should be interpreted based on the following claims, and includes technologies equivalent to those within the scope of the claims and all modifications so long as they are within the scope of the claims.

For example, although the above exemplary embodiments are applied to an image forming apparatus of an intermediate-transfer type that transfers toner images transferred on an intermediate transfer belt onto a sheet, the exemplary embodiments are not to be limited to an image forming apparatus of such a type, and may alternatively be applied to an image forming apparatus of a direct-transfer type that directly transfers a developer image on a photoconductor drum (as an example of an image bearing member) onto a sheet or the like.

Furthermore, although the above exemplary embodiments are applied to an example for forming a color image, the exemplary embodiments may alternatively be applied to an example for forming, for example, a monochrome image.

Furthermore, although a sheet of paper is used as a recording medium in the above exemplary embodiments, various kinds of recording media on which an image can be formed, such as a film or a postcard, may be used.

Although the above exemplary embodiments of the present invention are applied to a color printer, the exemplary embodiments may alternatively be applied to other kinds of image forming apparatuses, such as a color copier, a facsimile apparatus, or an image forming apparatus having both copying and facsimile functions.

What is claimed is:

1. A fixing device comprising:

a heating member configured to heat a recording medium to fix an unfixed developer image transferred on the recording medium onto the recording medium;

an endless heating belt that is wrapped around the heating member in a rotatable manner, in a circumferential direction of the endless heating belt, and configured to heat the recording medium;

a rotating member around which the endless heating belt is wrapped and that is provided in a rotatable manner in a state where a first axial end of the rotating member is fixed;

a position detecting unit configured to detect a position of the endless heating belt when the endless heating belt is periodically reciprocated back and forth in a first direction and a second direction, which are opposite to each other and extend parallel to an axial direction of the rotating member; and a controller configured to control a rotational movement angle by which a second axial end of the rotating member is rotationally moved about the first axial end of the rotating member in a direction intersecting the axial direction such that the second axial end is periodically reciprocated back and forth passing through the axial direction on the basis of the position of the endless heating belt detected by the position detecting unit when the endless heating belt is periodically reciprocated back and forth in the first direction and the second direction so that a difference between a first period in which the endless heating belt is reciprocated in the first direction and a second period in which the endless heating belt is reciprocated in the second direction is made smaller, wherein the controller is configured to control the rotational movement angle by which the second axial end of the rotating member is rotationally moved about the first axial end of the rotating member in the direction intersecting the axial direction so that the endless heating belt is configured to move in the first direction or the second direction based on the position detecting unit detecting that a center of the endless heating belt is positioned at a center of the rotating member in the axial direction of the rotating member.

2. The fixing device according to claim 1, wherein the controller is configured to change a distance by which the endless heating belt is periodically reciprocated back and forth in the first direction and the second direction in accordance with a type of the recording medium or a traveling speed of the recording medium in the fixing device.

3. The fixing device according to claim 1, wherein the controller is configured to store the rotational movement angle for the rotating member in accordance with a state of a fixing process and configured to use the stored rotational movement angle as an initial preset value when switching the state of the fixing process.

4. An image forming apparatus comprising:

the fixing device according to claim 1;

an image bearing member configured to bear a developer image;

a transfer unit configured to transfer the developer image on the image bearing member onto the recording medium, wherein the fixing device is configured to fix the developer image, transferred on the recording medium in an unfixed state, onto the recording medium.

5. The fixing device according to claim 1, wherein the controller is configured to control the rotational movement angle by which the second axial end of the rotating member is rotationally moved about the first axial end of the rotating member in the direction intersecting the axial direction such that the second axial end is periodically reciprocated back and forth at predetermined time periods passing through the axial direction on the basis of the position of the endless heating belt detected by the position detecting unit when the endless heating belt is periodically reciprocated back and forth in the first direction and the second direction so that the difference between the first period and the second period is made smaller.

6. The fixing device according to claim 1, wherein the position detecting unit is disposed at the second axial end of the rotating member, and wherein the position detecting unit comprises three sensors and a control shaft comprising a light blocking portion.

7. The fixing device according to claim 1, wherein the controller is configured to control the rotational movement angle by which the second axial end of the rotating member is rotationally moved about the first axial end of the rotating member in the direction intersecting the axial direction such that the second axial end is periodically reciprocated back and forth passing through the axial direction on the basis of the position of the endless heating belt detected by the position detecting unit when the endless heating belt is periodically reciprocated back and forth in the first direction and the second direction so that the first period is closer to the second period.

8. The fixing device according to claim 1, wherein the controller is configured to control the rotational movement angle by which the second axial end of the rotating member is rotationally moved about the first axial end of the rotating member in the direction intersecting the axial direction such that the second axial end is periodically reciprocated back and forth passing through the axial direction on the basis of the position of the endless heating belt detected by the position detecting unit when the endless heating belt is periodically reciprocated back and forth in the first direction and the second direction so that the first period is substantially equal to the second period.

9. The fixing device according to claim 1, wherein the controller is configured to control the rotational movement angle by which the second axial end of the rotating member is rotationally moved about the first axial end of the rotating member in the direction intersecting the axial direction such that the second axial end is periodically reciprocated back and forth passing through the axial direction on the basis of the position of the endless heating belt detected by the position detecting unit when the endless heating belt is periodically reciprocated back and forth in the first direction and the second direction so that the first period is equal to the second period.

* * * * *